US009476005B1

(12) United States Patent
Schuetzle et al.

(10) Patent No.: US 9,476,005 B1
(45) Date of Patent: Oct. 25, 2016

(54) HIGH-PERFORMANCE DIESEL FUEL LUBRICITY ADDITIVE

(71) Applicants: Robert Schuetzle, Sacramento, CA (US); Dennis Schuetzle, Grass Valley, CA (US)

(72) Inventors: Robert Schuetzle, Sacramento, CA (US); Dennis Schuetzle, Grass Valley, CA (US)

(73) Assignee: Greyrock Energy, Inc., Sacramento, CA (US)

( * ) Notice: Subject to any disclaimer, the term of this patent is extended or adjusted under 35 U.S.C. 154(b) by 133 days.

(21) Appl. No.: 13/987,133

(22) Filed: Jul. 1, 2013

Related U.S. Application Data

(60) Provisional application No. 61/855,832, filed on May 24, 2013.

(51) Int. Cl.
*C10L 1/18* (2006.01)
*C10L 10/08* (2006.01)

(52) U.S. Cl.
CPC ..... *C10L 10/08* (2013.01)

(58) Field of Classification Search
CPC ..... C10L 10/08; C10L 1/188; C10L 1/1883; C10L 1/182; C10L 1/1824
See application file for complete search history.

(56) References Cited

U.S. PATENT DOCUMENTS

| | | | | |
|---|---|---|---|---|
| 5,194,068 | A | 3/1993 | Mohr | |
| 6,001,141 | A | 12/1999 | Quigley | |
| 6,017,372 | A | 1/2000 | Berlowitz | |
| 6,051,039 | A * | 4/2000 | Sugimoto | 44/341 |
| 6,156,082 | A | 12/2000 | MacMillan | |
| 6,793,695 | B2 | 9/2004 | Wilkes | |
| 7,182,795 | B2 | 2/2007 | Henly et al. | |
| 7,867,295 | B2 | 1/2011 | Schield | |
| 8,097,570 | B2 * | 1/2012 | Boitout et al. | 508/489 |
| 2005/0132641 | A1 | 6/2005 | McCallum | |
| 2006/0288638 | A1 | 12/2006 | Schwab | |

FOREIGN PATENT DOCUMENTS

| | | | |
|---|---|---|---|
| WO | WO9835000 | * | 8/1998 |

* cited by examiner

*Primary Examiner* — Cephia D Toomer
(74) *Attorney, Agent, or Firm* — Jeffrey A. McKinney; McKinney Law Group APC

(57) ABSTRACT

The present teachings are directed toward the invention of high-performance diesel fuel lubricity additives that are comprised of a mixture of one or more $C_3$-$C_{10}$ di-carboxylic acids with a mixture of one or more $C_3$-$C_{14}$ carboxylic acids that are blended in one or more $C_3$-$C_{16}$ hydroxy-alkanes. These additives may be produced by blending one or more $C_3$-$C_{14}$ carboxylic acids, $C_3$-$C_{10}$ di-carboxylic acids and $C_3$-$C_{16}$ hydroxy-alkanes, or by using various chemical synthesis procedures to directly produce mixtures of these classes of oxygenated aliphatic hydrocarbons.

11 Claims, 2 Drawing Sheets

HIGH-PERFORMANCE DIESEL FUEL LUBRICITY ADDITIVE

CROSS-REFERENCE TO RELATED APPLICATION

This application claims the benefit of U.S. Provisional Application No. 61/855,832, filed May 24, 2013, which is incorporated-by-reference into this document in its entirety.

FIELD OF THE INVENTION

The present invention relates to a unique blend of three classes of oxygenated organic compounds (dicarboxylic acids, carboxylic acids and hydroxy-alkanes) that are combined together to produce high-performance diesel fuel additives. When these additives are blended at the proper levels with traditional, synthetic diesel fuels, the blended fuel exhibits improved lubricity (as measured by ASTM standard procedures).

BACKGROUND OF THE INVENTION

During the past three decades, many diesel fuel performance additives have been developed and marketed to improve fuel lubricity, enhance engine performance, increase fuel economy, reduce tailpipe emissions and increase engine life. These diesel fuel performance additives are typically formulated by adding one or more organic compounds to a hydrocarbon base. These additives are generally mixed with diesel fuel at the 100-5,000 ppm level.

Many of the diesel fuel additives utilized to date, have been specifically designed to improve fuel lubricity. Lubricity refers to the ability of a fluid to minimize the degree of friction between surfaces in relative motion under load conditions. A lubricity value of a fuel can be measured by a standard test method, such as ASTM D6079 or D6751. ASTM D6079 is the preferred test method for evaluating the lubricity of diesel fuel which is commonly referred to as the high-frequency reciprocating test procedure (HFRR). The wear scar generated in the HFRR is measured in terms of a diameter of wear scar in microns. Smaller wear scars are directly related to better fuel lubricity.

The combustion of fuels high with sulfur, for example, in conventional middle distillates such as diesel fuel and jet fuel, is considered a serious environmental problem because the sulfur is emitted as sulfur oxides which contribute adversely to airborne particulates and acid rain. Therefore, government regulations have been promulgated that significantly limit the amount of sulfur which may be present in such fuels. In the present context the terminology "low sulfur-content fuels" are intended to mean fuels typically having a sulfur content of less than 50 ppm by weight and more preferably less than 15 ppm by weight. Other fuels that have poor lubricating properties include synthetic diesel fuels that are produced from the hydro-processing of waxes formed from the catalytic conversion of syngas ($H_2$ and CO).

Unfortunately, diesel fuels with low lubricity can cause excessive wear to engine components and damage to fuel pumps and injectors. Therefore, lubricity additives are blended with most commercially available diesel fuels.

A number of diesel fuel lubricity additives have been previously formulated and used to enhance lubricity performance characteristics. However, as established below, the high-performance additive outlined in this present teaching is very different from the currently available additive formulations that have been published in the patent and scientific literature.

It has been known since the early 1990's that $C_{12}$-$C_{30}$ fatty acid esters and fatty acids are good diesel fuel lubricity additives when added in sufficient quantities, typically greater than 500-10,000 ppm. Several recent formulations have been developed that utilize these fatty acids and fatty acid esters as a base with the addition of other chemical constituents to improve additive performance.

For example, U.S. Pat. No. 6,793,695 describes a lubricity additive containing fatty acid esters containing 8 to 24 carbon atoms and the addition of a hydrocarbyl monoamine or hydrocarbyl-substituted poly alkylene-amine to increase additive performance.

U.S. Pat. Application Pub. No. 0132641 describes a lubricity additive that is based upon the reaction products of saturated, unsaturated, mixed saturated and unsaturated di- and tri-carboxylic acids having from 12 to 72 carbon atoms with hydroxyl compounds selected from the group consisting of alcohols, glycols and poly-glycols. The resulting formulation is a mixture of esters which are proposed as lubricity additives.

One of the problems with using fatty acids and fatty acid esters as lubricity agents is that they can cause engine problems (Pillay, 2012) such as engine deposits.

The high-performance additive described in this application does not require the use of any fatty acid or fatty acid esters as described in the above prior art.

U.S. Pat. Application Pub. No. 0288638 A1 describes a fuel lubricity additive that incorporates a mixture of at least one alicyclic amine and at least one fatty acid, having between eight and 22 carbon atoms.

U.S. Pat. No. 5,194,068 discloses fuel compositions containing small amounts of an ester of a mono- and/or polycarboxylic acid with an alkyl alkanol-amine or alkyl amino-polyalkylene glycol.

U.S. Pat. No. 6,001,141 describes a diesel fuel additive that contains a carboxylic acid substituted by a least one hydroxyl group, derivatives of the carboxylic acid substituted by at least one hydroxy group, and an ester which is the reaction product of a carboxylic acid which does not contain any hydroxy substitution in the acid backbone and an alkanol-amine.

U.S. Pat. No. 7,182,795 B2 describes a diesel fuel additive that is synthesized from the chemical reaction of a hydro-carbonyl succinic anhydride and a hydroxy-amine.

The high-performance additive described in this application does not require the use of alicyclic amines, alkyl alkanol-amines or alkyl amino-polyalkylene glycols as described in the above prior art.

U.S. Pat. No. 7,867,295 describes a diesel fuel additive that utilizes highly branched carboxylic acids (e.g. trialkyl acetic acid and dimethyl propionic acid) dissolved in aromatic solvents. This additive formulation faces some major challenges as follows: 1) These di-methyl and tri-methyl-branched $C_3$-$C_{14}$ carboxylic acids have limited solubility in aromatic solvents; 2) Many of these branched acids are not commercially available and/or costly; and 3) These branched acids have difficulty forming chemical bonds with iron surfaces due to steric hindrance from the methyl groups on the acids.

Berlowitz (U.S. Pat. No. 6,017,372) describes the formulation of additives that employ esters, polyols, alkenes and aldehydes. However, the additive described herein does not contain these organic mixtures.

MacMillan (U.S. Pat. No. 6,156,082) describes a formulation to improve diesel fuel lubricity which employs mixtures of $C_{10}$-$C_{32}$ alkenes (e.g., olefins) substituted with alkyl ethers. A major problem with such formulations is that alkenes degrade (oxidize) rapidly under typical friction conditions, reducing their effectiveness.

SUMMARY OF THE INVENTION

Embodiments of the invention describe methods for preparing the high performance diesel fuel additive formulations from individual $C_3$-$C_{14}$ carboxylic acids (e.g., propanoic acid, butanoic acid, pentanoic acid, hexanoic acid, heptanoic acid, octanoic acid, nonanoic acid, decanoic acid, undecanoic acid, dodecanoic acid, tridecanoic acid, tetradecanoic acid) and $C_3$-$C_{10}$ di-carboxylic acids (e.g., malonic, succinic acid, glutaric acid, adipic acid, pimelic acid, suberic acid, azelaic acid, sebacic acid) in one or more $C_3$-$C_{16}$ hydroxy-alkanes (e.g., propanol, butanol, pentanol, hexanol, heptanol, octanol, nonanol, decanol, undecanol, dodecanol, tridecanol, tetradecanol, pentadecanol, hexadecanol).

When this high performance diesel fuel additive is produced in accordance with embodiments of the invention and blended with diesel fuels, one or more performance characteristics described in the corresponding ASTM fuel specifications are improved when compared to the neat diesel fuel. For example, the improved performance characteristic primarily includes lubricity, but Cetane number, oxidative stability, and improved engine performance are recognized. In addition, tailpipe emissions of nitrogen oxides, carbon monoxide, hydrocarbons and particulates may be reduced.

The term "diesel fuel" refers to any liquid fuel used in diesel engines. A diesel fuel includes a mixture of carbon chains that typically contain between 8 to 24 carbon atoms per molecule. A conventional diesel fuel is a petroleum derived diesel fuel or petro diesel which is a distillate from crude oil obtained by collecting a fraction boiling at atmospheric pressure over an approximate temperature range of 165° C. (5% distilled) to 375° C. (end point) as defined by the ASTM procedure D86. A diesel fuel may also include a synthetic diesel (sometimes referred to as a Fisher-Tropsch diesel) derived from alternative sources (e.g., renewable biomass, waste organic materials or natural gas) or a biodiesel produced from various native oils and fats (e.g., palm oil). Other, non-limiting examples of diesel fuel include: #1 diesel fuel, #2 diesel fuel, JP-5 fuel, JP-8 diesel fuel.

In embodiments of the invention, this neat, high-performance diesel fuel additive has a HFRR lubricity value of 320-400, preferably 350-375, and/or a film thickness of 1-20%, preferably between 2-6%, depending upon the relative concentrations of the mixtures of one or more $C_3$-$C_{14}$ carboxylic acids and $C_3$-$C_{10}$ di-carboxylic acids in one or more $C_3$-$C_{16}$ hydroxy-alkanes.

All of these and other suitable ASTM standards can be adopted to test performance characteristics of fuels in accordance with embodiments of the invention. These and other ASTM standard test methods are hereby incorporated by reference in their entirety.

The performance characteristics (e.g., measured by ASTM tests) of this high-performance diesel fuel lubricity additive in accordance with the present invention are 5-60% (e.g., 5-50%, 5-40%, 5-30%, 5-20%, 5-10%, 10%-20%) better than the corresponding performance characteristic values of the original, neat diesel fuel.

For example, if a petroleum diesel has a value of 540 and the high-performance additive has a lubricity value of 340, then the lubricity value of the petroleum diesel will be improved by greater than 10% when added at the 50 ppm level.

In another embodiment of the invention, when the high-performance additive is blended with a diesel fuel in accordance with the present invention at blend levels of approximately 50-1000 ppm (e.g., 50-750 ppm, 50-500 ppm, 50-250 ppm, 250-1000 ppm, 500-1000 ppm, 250 ppm-750 ppm, 250 ppm-500 ppm), this mixture improves the performance characteristics of the blended fuel by at least 5% and as much as 50% or more compared to the original performance characteristics of the neat diesel fuel.

DETAILED DESCRIPTION OF THE INVENTION

Research studies were carried out to determine the chemical species and the chemical processes that contribute to the unique properties of the unique diesel fuel lubricity additives described herein. It was found that $C_3$-$C_{10}$ di-carboxylic acids and $C_3$-$C_{14}$ carboxylic acids were primarily responsible for the enhanced lubricity properties. In addition, it was discovered that the $C_3$-$C_{16}$ hydroxy-alkanes alone did not provide much added lubricity to diesel fuels. However, these hydroxy-alkanes enhanced the lubricity of the di-carboxylic acids by forming an ester with the free carboxylic group under high temperature conditions such as that encountered in diesel engines.

Figure 1:
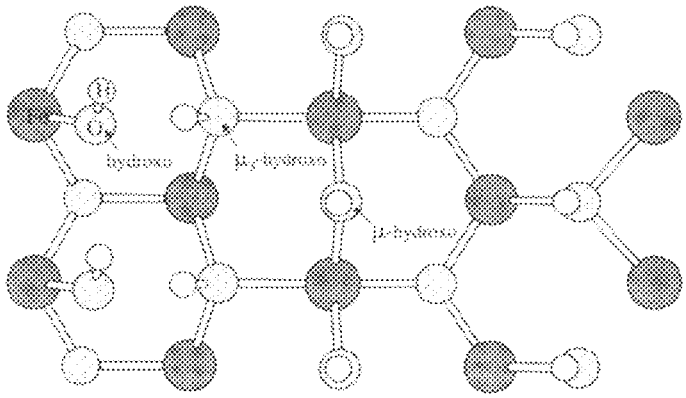
FIG. 1 shows a 3-D model of iron oxy-hydroxide on an iron surface.
Figure 2:
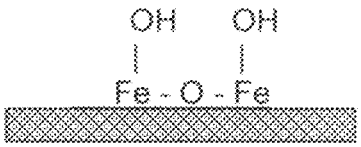
FIG. 2 shows a 2-D model of iron oxy-hydroxide on an iron surface.

In order to understand how the fuel additive described herein contributes to improved lubricity, surface chemistry and surface modeling studies were employed using procedures previously described in scientific journals [Schuetzle (1986); Rustad (2000); and Makowska (2002)] to help determine how these di-carboxylic acids, carboxylic acids and hydroxy-alkanes interact with iron surfaces under friction conditions. It was established from these studies that iron surfaces are comprised primarily of iron oxy-hydroxide (FeOOH) and iron oxide ($Fe_2O_3$). A 3-D model of the iron oxy-hydroxide on an iron surface is shown in FIG. 1 and a 2-D model is shown in FIG. 2.

It was discovered that carboxylic acids chemically react with the iron oxy-hydroxide group under typical engine operating conditions to produce strong chemical bonds. As a result, these organic acids help provide a robust organic surface barrier between moving iron surfaces. In comparison, organic esters, aldehydes, alcohols, amides and amines do not chemically react with the iron oxy-hydroxide and as a result they do not create a strong organic chemical barrier to protect wear between moving iron surfaces.

Further studies on the surface reactions for carboxylic acids, dicarboxylic acids and hydroxy-alkanes with iron surfaces was carried out to establish a chemical understanding of why this high-performance additive formulation has superior lubricity performance compared to other additive formulations developed to date.

Figure 3:
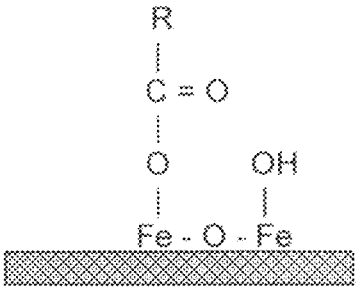
FIG. 3 shows product formed from the surface reaction of the carboxylic acid constituent with one iron oxy-hydroxide moiety covering the iron substrate surface (where R=$C_2$-$C_{13}$).
Figure 4:
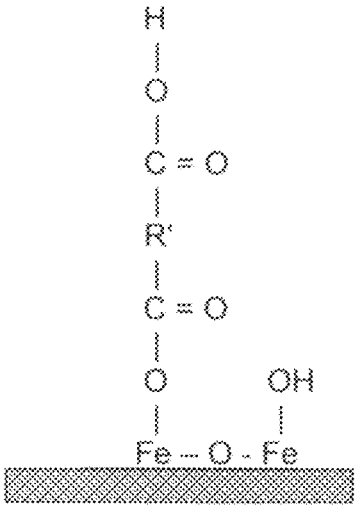
FIG. 4 shows product formed from the surface reaction of the dicarboxylic acid constituent with one iron oxy-hydroxide moiety covering the iron substrate surface (where R'=$C_1$-$C_8$).

As described previously, the acid groups in the carboxylic acids (R—COOH) and dicarboxylic acids (HOOC—R—COOH) form strong chemical bonds with the iron oxide layer (FIGS. 3 and 4), thus protecting the iron surface from excessive wear.

Figure 5:
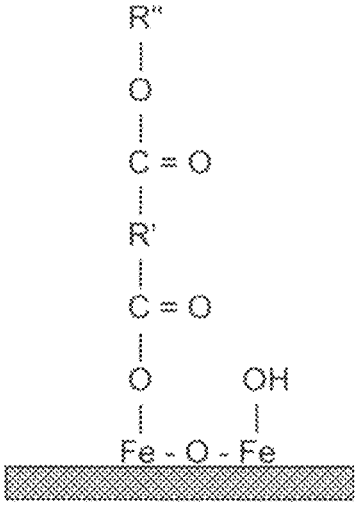
FIG. 5 shows product formed from the surface reaction of the di-carboxylic acid constituent with one iron oxy-hydroxide moiety covering the iron substrate surface and subsequently with one of the hydroxyl-alkanes (R"—OH where R"=$C_3$-$C_{16}$ and R'=$C_1$-$C_8$).
Figure 6:
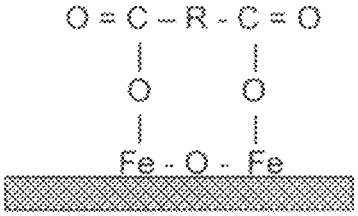
FIG. 6 shows product formed from the surface reaction of the di-carboxylic acid constituent with two adjacent iron oxide moieties covering the iron substrate surface (R=$C_1$-$C_8$).

Other surface chemical reactions were found to be important. One of the acid groups on the dicarboxylic acid forms a strong chemical bond as before with the iron oxide layer, while the other acid moiety is free to react with one of the primary organic alcohols (R"—OH) to form an ester with the remaining acid group (FIG. 5), thus enhancing lubricity. This other acid moiety can also react with a nearby iron oxide moiety to produce another chemical bond (FIG. 6), thus provide additional protection from excessive surface wear.

The carboxylic acids, dicarboxylic acids and hydroxy-alkanes in the high-performance additive all play an important synergistic role in protecting engine surfaces from wear.

Illustrative examples are heretofore provided that demonstrate lubricity improvements from high-performance diesel fuel additive formulations.

Example 1

Lubricity of Formulated Diesel Fuel Additives

Some moving parts of diesel fuel pumps and injectors are protected from wear by the fuel. To avoid excessive wear, the fuel must have some minimum level of lubricity. Lubricity is the ability to reduce friction between solid surfaces in relative motion. The lubrication mechanism is a combination of hydrodynamic lubrication and boundary lubrication. In hydrodynamic lubrication, a layer of liquid prevents contact between the opposing surfaces. For diesel fuel pumps and injectors, the liquid is the fuel itself and viscosity is the key fuel property. Boundary lubrication becomes important when high load and/or low speed have squeezed out much of the liquid that provides hydrodynamic lubrication, leaving small areas of the opposing surfaces in contact. Boundary lubricants are compounds that form a protective anti-wear layer by adhering to the solid surfaces. As described earlier, one method widely used is the high frequency reciprocating rig (HFRR). Many regions of the world have fuel specifications based on this test method. Table 1 summarizes typical HFRR results from low sulfur California diesel fuel (CA diesel #2) and U.S. diesel fuel (U.S. diesel #2).

Blended fuels according to embodiments of the invention have a number of performance characteristics measurable by ASTM tests which are superior compared to the corresponding characteristics of the petroleum fuel. To further illustrate embodiments of the present invention, two examples are provided that describe the significant advantage of these high performance diesel fuel additives on the improvement of fuel lubricity compared to other suggested and commercial additives.

Preparation of Lubricity Additive Formulation A—

Formulation A was prepared and the lubricity performance of this formulation was evaluated. This formulation was produced by mixing commercially available quantities of 5.55 g of glutaric acid, 48.79 g of octanoic acid and 95.31 g of heptanol, resulting in a fuel additive that consisted of 3.70 wt. % glutaric acid, 32.6 wt. % octanoic acid and 63.7 wt. % heptanol. This mixture was found to have an HFCC lubricity value of 340 (Table 1). This excellent lubricity is the result of the surface reactions of the glutaric acid, octanoic acid and heptanol with the iron substrates as described above.

TABLE 1

HFCC Results for Individual Additive Ingredients, One Embodiment of the Additive Formulation and Commercial Diesel Fuels

| Constituents | HFCC Results |
|---|---|
| HPDA-A Ingredients | |
| Octanoic Acid | 100 |
| Glutaric Acid (10 g in 100 ml of heptanol) | 70 |
| 1-Heptanol | 420 |
| HPDA-A Formulation | |
| Neat Formulation A | 340 |
| Diesel Fuels | |
| CA diesel #2 (low sulfur) | 540 |

Performance of Lubricity Additive Formulation A—

Table 2 provides data for the HFRR lubricity values (ASTM D6079) of a California #2 fuel blended with varying proportions of additive formulation A at 50, 250, 500 and 1,000 ppm levels.

TABLE 2

The Effect of Various Concentrations of Additive A on the Lubricity Improvement of California Diesel Fuel #2

| Additive Concentrations | HFCC Results |
|---|---|
| Neat CA # 2 Diesel Fuel (low sulfur) | 540 |
| 50 ppm | 465 |
| 250 ppm | 360 |
| 500 ppm | 345 |
| 1,000 ppm | 352 |
| Neat Additive A | 340 |

100% California #2 diesel fuel has a HFRR lubricity value of 540. When the additive A is blended at 50 ppm, the HFRR lubricity of the blended fuel is improved to 465. When additive A is blended at 250 ppm, the HFRR lubricity of the blended fuel is improved to 360. When additive A is blended at 500 ppm the HFRR lubricity of the blended fuel is improved to 345. When additive A is blended at 1,000 ppm the HFRR lubricity of the blended fuel is improved to 352. The HFRR lubricity for neat additive A is 340. It can be seen from the data above that blending of the high-performance diesel fuel lubricity additive described herein provides performance improvement benefits in excess of the improvement expected from the blend level and that blending above about 250-500 ppm does not significantly increase the fuel lubricity.

Example 2

Synthesis of Lubricity Additive Formulation B

Additive formulation B was produced from the reaction of syngas ($H_2$/CO molar ratio of ~2/1) over a unique iron-based native mineral catalyst to produce a mixture of $C_3$-$C_{16}$ oxygenated n-Alkanes (35 weight %), $C_7$-$C_{24}$ n-Alkanes (55 weight %) and $C_7$-$C_{16}$n-Alkenes (10 weight %) (Table 3).

The iron-based native mineral catalyst was produced from the separation of specific iron-based minerals present in "black sands." These black sands are readily available naturally in the U.S. and several other countries. These naturally occurring "black sands" contain various proportions of iron based minerals such as Ilmenite ($FeTiO_3$), Chromite ($FeCrO_3$), Hematite ($Fe_2O_3$), Magnetite ($Fe_3O_4$), Titanomagnetite ($Fe_3Ti_2O_4$) and Bauxite $(FeAlTi)_2O_3$, depending upon the location.

These natively occurring Ilmenite, Chromite and Hematite, Magnetite, Titanomagnetite and Bauxite minerals are very hard, micro-crystalline materials that contain iron in various valence states. They can be easily reduced to catalytically active states using hydrogen, carbon monoxide or hydrogen/carbon monoxide mixtures at moderate temperatures (500-550° F.). As a result, some of these native minerals have been demonstrated to be excellent Fisher-Tropsch (F-T) catalysts for the production of oxygenated aliphatic hydrocarbons.

The specific "black sand" used for the production of the high-performance diesel fuel additive B contained about 65 weight % Magnetite, 30 weight % Hematite, and 5% of other materials such as aluminum oxide and silicon. This particular "black sand" material also contained a mixture of precious metals (Au, Ag, Pt, Rh, Os, Ru, Pd and Ir) at a combined concentration of 1440 ppm. The catalyst was operated at a temperature of 460° F. and a gas space velocity of 4,000 in a tubular catalytic reactor to directly convert mixtures of hydrogen and carbon monoxide (~2/1) ratio to diesel fuel additive B.

The approximate distribution of the 35% $C_3$-$C_{16}$ oxygenated n-alkanes in this additive formulation B is summarized in Table 4. This mixture was found to have an HFRR lubricity of 346.

TABLE 3

Distribution of $C_3$-$C_{16}$ Oxygenated n-Alkanes, $C_8$-$C_{24}$ N-Alkanes and $C_8$-$C_{16}$ n-Alkenes in Product Mixture B

| Components | Wt. % |
|---|---|
| $C_3$-$C_{16}$ Oxygenated n-Alkanes | 35 |
| $C_7$-$C_{24}$ n-Alkanes | 55 |
| $C_7$-$C_{16}$ n-Alkenes | 10 |

TABLE 4

Approximate Distribution of the 35% $C_3$-$C_{16}$ Oxygenated n-Alkanes in Product Mixture B

| Components | Wt. % |
|---|---|
| $C_3$-$C_{16}$ n-Hydroxy-alkanes | 89 |
| $C_3$-$C_{14}$ n-Carboxylic Acids | 9 |
| $C_3$-$C_{10}$ di-Carboxylic Acids | 2 |

Performance of Lubricity Additive Formulation B—

Table 5 provides data for the HFRR lubricity values (ASTM D6079) of California #2 diesel fuel blended with varying proportions of additive B. Additive B was added to the CA #2 diesel fuel at 50, 250, 500 and 1,000 ppm levels.

100% California #2 diesel fuel has a HFRR lubricity value of 540. When the additive B is blended at 50 ppm, the HFRR lubricity of the blended fuel is improved to 480. When additive B is blended at 250 ppm, the HFRR lubricity of the blended fuel is improved to 420. When additive B is blended at 500 ppm the HFRR lubricity of the blended fuel is improved to 355. When additive B is blended at 1,000 ppm the HFRR lubricity of the blended fuel is improved to 357. The HFRR lubricity for neat additive B is 346. It can be seen from the data above that blending of the high-performance diesel fuel additive described herein provides performance improvement benefits in excess of the improvement expected from the blend level and blending above about 500-1,000 ppm does not increase the fuel lubricity.

TABLE 5

The Effect of Various Concentrations of Additive B on the Lubricity Improvement of California Diesel Fuel #2

| Additive Concentrations | HFCC Results |
|---|---|
| Neat CA #2 Diesel Fuel (low sulfur) | 540 |
| 50 ppm | 480 |
| 250 ppm | 420 |
| 500 ppm | 355 |
| 1,000 ppm | 357 |
| Neat Additive B | 346 |

REFERENCES CITED

| U.S. patent application Publications | | |
|---|---|---|
| 0288638 A1 | December 2006 | Schwab |
| 0132641 A1 | June 2005 | McCallum et al |
| U.S. Patent Documents | | |
| 5,194,068 A | March 1993 | Mohr et al. |
| 6,001,141 A | November 1996 | Quigley |
| 6,017,372 A | January 2000 | Berlowitz et al |
| 6,156,082 A | December 2000 | MacMillan et al |
| 6,793,695 B2 | September 2004 | Wilkes et al |
| 7,182,795 B2 | February 2007 | Henly et al |
| 7,867,295 B2 | January 2011 | Schield et al |

OTHER PUBLICATIONS

Schuetzle, D. et al, "The Chemical Interaction of Organic Materials with Metal Substrates," Applied Spectroscopy, 40, 641-649 (1986)

Rustad, J. R. et al, "Intrinsic Acidity of Aluminum, Chromium (III) and Iron (III) Hydroxy Functional Groups from Ab Initio Electronic Structure Calculations," Geochimica et Cosmochimica Acta, 64-10, 1575-1680 (2000).

Makowska, M. et al, "Interactions of n-Hexadecane with Steel Surfaces under Friction Conditions," Tribology Letters, 13-2, 65-70 (2003).

Pillay, A. E. et al, "Engine Emissions and Performance with Biodiesel Fuels," Journal of Sustainable Development, Vol. 5, #4 (2012).

The invention claimed is:

1. A high performance diesel fuel additive formulation, which consists essentially of a mixture of one or more $C_3$-$C_{10}$ di-carboxylic acids and one or more $C_3$-$C_{14}$ carboxylic acids dissolved in a mixture of one or more $C_3$-$C_{16}$ hydroxy-alkanes, wherein the alkane of the hydroxyl-alkanes is non-branched or branched, and wherein the $C_3$-$C_{16}$ hydroxy-alkanes react with a carboxylic acid group on the $C_3$-$C_{10}$ di-carboxylic acids to form esters under high temperature conditions in a diesel engine.

2. The formulation according to claim 1, wherein the alkane is non-branched.

3. The formulation according to claim 1, wherein the alkane is branched.

4. The formulation according to claim 3, wherein the one or more di-carboxylic acids are selected from a member of a group consisting of malonic acid, succinic acid, glutaric acid, adipic acid, pimelic acid, suberic acid, azelaic acid and sebacic acid.

5. The formulation according to claim 3, wherein the one or more carboxylic acids are selected from a member of a group consisting of propanoic acid, butanoic acid, pentanoic acid, hexanoic acid, octanoic acid, nonanoic acid, decanoic acid, undecanoic acid, dodecanoic acid, tridecanoic acid and tetradecanoic acid.

6. The formulation according to claim 3, wherein the one of more hydroxyl alkanes are selected from a member of a group consisting of propanol, butanol, pentanol, hexanol, heptanol, octanol, nonanol, decanol, undecanol, dodecanol, tridecanol, tetradecanol, pentadecanol and hexadecanol.

7. A lubricity additive consisting essentially of 2-15% by weight of one or more $C_3$-$C_{10}$ di-carboxylic acids and approximately 2-35% by weight of a mixture of one or more of $C_3$-$C_{14}$ carboxylic acids dissolved in one or more $C_3$-$C_{16}$ hydroxy-alkanes, wherein the C3-C16 hydroxy-alkanes react with a carboxylic acid group on the C3-C10 dicarboxylic acids to form esters under high temperature conditions in a diesel engine.

8. The additive according to claim 7, wherein the additive is added at a concentration of 50 to 1000 ppm by volume into a neat diesel fuel to provide a mixture.

9. The additive according to claim 8, wherein the diesel fuel consists of one or more of the following diesel fuels: #1 diesel fuel, #2 diesel fuel, JP-5 diesel fuel, JP-8 diesel fuel, synthetic diesel fuel, and Fischer-Tropsch diesel fuel.

10. The additive according to claim 8, wherein the mixture improves the average lubricity of diesel fuel from about 10-35%.

11. A high performance diesel fuel additive formulation, which consists essentially of a mixture of one or more di-carboxylic acids and one or more carboxylic acids dissolved in a mixture of one or more hydroxyl-alkanes, wherein the alkane of the hydroxyl-alkanes is non-branched or branched, wherein the one or more di-carboxylic acids are selected from a member of a group consisting of malonic acid, succinic acid, glutaric acid, adipic acid, pimelic acid, suberic acid, azelaic acid and sebacic acid, and wherein the one or more hydroxyl-alkanes react with a carboxylic acid group on the one or more di-carboxylic acids to form esters under high temperature conditions in a diesel engine.

* * * * *